United States Patent [19]

McHale et al.

[11] 4,276,152

[45] Jun. 30, 1981

[54] REFORMING OF SULFUR-CONTAINING CHARGE STOCK

[75] Inventors: William D. McHale, Mantua; Hans-Juergen Schoennagel, Lawrenceville, both of N.J.

[73] Assignee: Mobil Oil Corporation, Fairfax, Va.

[21] Appl. No.: 78,355

[22] Filed: Sep. 24, 1979

[51] Int. Cl.[3] ..... C10G 35/08

[52] U.S. Cl. ..... 208/139; 208/138

[58] Field of Search ..... 208/138, 139

[56] References Cited

U.S. PATENT DOCUMENTS

| | | | |
|---|---|---|---|
| 2,848,377 | 8/1958 | Webb | 208/138 |
| 2,854,400 | 9/1958 | Weisz | 208/111 |
| 2,854,403 | 9/1958 | Weisz | 208/138 |
| 2,854,404 | 9/1958 | Prater et al. | 208/139 |
| 3,507,781 | 4/1970 | Spurlock et al. | 208/139 |
| 3,554,902 | 1/1971 | Buss | 208/139 |
| 3,953,368 | 4/1976 | Sinfelt | 208/139 |
| 4,124,491 | 11/1978 | Antos et al. . | |

FOREIGN PATENT DOCUMENTS

| | | |
|---|---|---|
| 9309 | 8/1979 | European Pat. Appl. |
| 2627822 | 2/1977 | Fed. Rep. of Germany . |
| 2320979 | 3/1977 | France . |

*Primary Examiner*—Curtis R. Davis

*Attorney, Agent, or Firm*—Charles A. Huggett; Charles J. Speciale

[57] ABSTRACT

Process for reforming a hydrocarbon charge under reforming conditions in a reforming zone wherein added sulfur is introduced into said zone to counteract excessive hydrocracking of said charge utilizing a catalyst consisting essentially of a minor proportion of platinum on a support and a minor proportion of iridium on a separate support.

16 Claims, 7 Drawing Figures

ACTIVITY AT 98 R+O 0.17°/Day
15°
0.15°/Day
S Added 2.5 ppm
Days on Stream
Inlet Temperature °F
970
960
950
940
930
920
910
0
5
10
15
20
25
30
35
40
45
50
55

ACTIVITY AT 98 R+O

ACTIVITY AT 98 R+O

ACTIVITY AT 98 R+O

C5+ YIELD AT 98 R+O

C5+ Produced Vol.%
75
74
72
70
68
66
65
0
10
20
30
40
50
Days on Stream
SULFUR ADDED 2.5 PPM
○ CATALYST OF EXAMPLE 2
□ D-KX-130

REFORMING OF SULFUR-CONTAINING CHARGE STOCK

BACKGROUND OF THE INVENTION

1. Field of the Invention

This invention relates to a catalytic reforming process wherein a suitable charge stock, such as petroleum naphtha, is converted to a gasoline of high octane number under conditions which involve the presence of introduced sulfur into the reaction zone to counteract declining production of $C_5+$ product and where the catalyst contained in said zone consists essentially of separately supported platinum and separately supported iridium particles.

2. Description of the Prior Art

Catalysts intended for use in reforming operations wherein hydrocarbon fractions such as naphthas or gasolines or mixtures thereof are treated to improve the anti-knock characteristics thereof are well known in the petroleum industry.

It has heretofore been proposed to employ platinum metal-containing catalysts for promoting reforming. Such catalysts are necessarily characterized by a certain amount of acidity. One type of reforming catalyst which has been used commercially consists of an alumina base material having platinum metal impregnated thereon, with the acidity characteristic being contributed by a small amount of halogen incorporated in the catalyst.

In more recent years, multimetallic reforming catalysts, for example, bimetallic catalysts, have come into use. These catalysts generally contain platinum, together with one or more additional metals such as rhenium, germanium, iridium, palladium, osmium, ruthenium, rhodium, copper, silver, tin or gold deposited on a refractory support which also contains a specified amount of halogen. Representative of multimetallic reforming catalysts are those containing platinum and iridium, such as described in U.S. Pat. No. 2,848,377 and more recently in U.S. Pat. No. 3,953,368. The latter patent reports certain advantages when platinum and iridium are present on a refractory support as highly dispersed polymetallic clusters in which metallic atoms are separated by distances of about 2.5 to 4.0 Angstroms.

It has also heretofore been known to conduct catalytic reforming utilizing a catalyst consisting essentially of a particularly defined mixture of particles on a porous carrier impregnated with a small amount of platinum and particles of an acidic cracking component. Representative disclosures of such prior art are to be found in U.S. Pat. Nos. 2,854,400; 2,854,403; and 2,854,404. Also, it has been suggested, for example, in German O.S. No. 2,627,822 to conduct reforming in the presence of a catalyst constituting a mixture of platinum on one solid carrier and rhenium on a second solid carrier.

All of the above catalysts, while possessing certain advantages, suffer from inherent deficiencies in either activity, stability or sensitivity to poisons, e.g., sulfur, under severe reforming conditions.

During startup of a reforming operation, excessive amount of light gases, e.g., methane and ethane, are normally produced unless proper pretreatment procedures are utilized. The light hydrocarbon gases, produced as a result of high hydrocracking activity or metal-cracking activity of the catalyst, are particularly to be avoided during reforming since they decrease the yield of gasoline boiling products. Hydrocracking activity can be diminished if the catalyst is sulfided prior to contact with the charge stock. The presulfiding can be accomplished, for example, by passing a sulfur-containing gas, e.g., $H_2S$, through the catalyst bed. Other presulfiding treatments are known in the prior art. It has also been known that on startup and during operation, a small amount of sulfur added to the reforming zone effectively reduces the initial hydrocracking activity of the catalyst.

It is disclosed in U.S. Pat. No. 3,554,902 that intermittent sulfiding of a platinum-iridium catalyst during reforming improves the yield of gasoline product. Thus, as the yield of $C_5+$ product begins to decline during the reforming process, it has been reported that injection of a slug of sulfur into the reaction zone results in an increase in the yield. It is indicated that generally no more sulfur should be injected at a time than triple the theoretical amount to sulfide the platinum and iridium present on the catalyst.

It has also heretofore been reported, for example, in U.S. Pat. No. 3,507,781 that reforming catalysts comprising catalytically active amounts of platinum and iridium, deposited by coimpregnation of a solid porous support, such as alumina, are extremely sensitive to the presence of sulfur in the charge stock.

SUMMARY OF THE INVENTION

In accordance with the invention described herein, it has been unexpectedly found that reforming, under conditions wherein sulfur is introduced into the charge stock for the above purpose and as aforenoted, utilizing a platinum-iridium reforming catalyst consisting essentially of a minor proportion of platinum on a support and a minor proportion of iridium on a separate support provides a system which is much more resistant to sulfur than prior employed platinum-iridium reforming catalysts wherein both metals were deposited on or otherwise associated with a single support.

The process of the present invention thus comprises contacting a hydrocarbon charge under reforming conditions wherein sulfur is introduced into the reaction zone to diminish unwanted hydrocracking activity of a platinum-iridium reforming catalyst and to counteract declining production of $C_5+$ product during the course of reforming, wherein said catalyst is made up of a mixture of separately supported platinum and separately supported iridium particles.

In particular, the catalyst utilized in the process described herein comprises a refractory support, about 0.1 to about 5 weight percent of platinum, about 0.1 to about 5 weight percent of iridium and about 0.1 to about 5 weight percent of halogen, with the platinum and iridium being deposited on separate particles of the support.

The relative weight ratio of the separate particles containing platinum and those containing iridium is generally between about 10:1 and about 1:10. The dimensions of the separate particles may range from powder size, e.g., 0.01 micron up to particles of substantial size, e.g., 10,000 microns. Preferably, the particle size is between about 1 and about 3,000 microns.

The refractory support is contemplated as being an inorganic oxide and usually alumina, of the gamma or eta variety. The halogen component of the catalyst is present on both the particles containing platinum and those containing iridium. Halogen may be chlorine, bromine or fluorine, with particular preference being accorded chlorine. Thus, preferred catalysts for use in the process of this invention are compositions comprising separate particles of alumina base, containing a minor amount of chlorine, some of such particles having platinum deposited thereon and other of such particles having iridium deposited thereon, with the weight ratio of platinum to iridium being between about 10:1 and about 1:10 and preferably between about 5:1 and 1:5.

Reforming utilizing the described catalyst is conducted in the presence of hydrogen under reforming conditions. The latter include a temperature between about 700° F. and about 1100° F. and more usually between about 800° F. and about 1000° F.; a pressure within the range of about 50 to about 1000 psig and preferably between about 100 and about 700 psig and a liquid hourly space velocity of between about 0.1 and about 10 and preferably between about 0.5 and about 4. The molar ratio of hydrogen to hydrocarbon charge is generally between about 0.5 and about 20 and preferably between about 2 and about 12.

The process of the invention is particularly directed to reforming a hydrocarbon charge under the aforenoted conditions utilizing the specified platinum-iridium catalyst wherein platinum and iridium are deposited on separate particles of refractory support in operations wherein sulfur is introduced continuously either as a separate stream, e.g. $H_2S$, or in the form of other sulfur compounds such as thiophene, or as part of a sulfur containing chargestock into the reforming zone to conteract decline in yield of $C_5+$ product in an amount not exceeding about 50 ppm but greater than about 0.3 ppm of sulfur by weight of chargestock and preferably between about 0.5 and about 5 ppm.

DESCRIPTION OF SPECIFIC EMBODIMENTS

Figure 1:
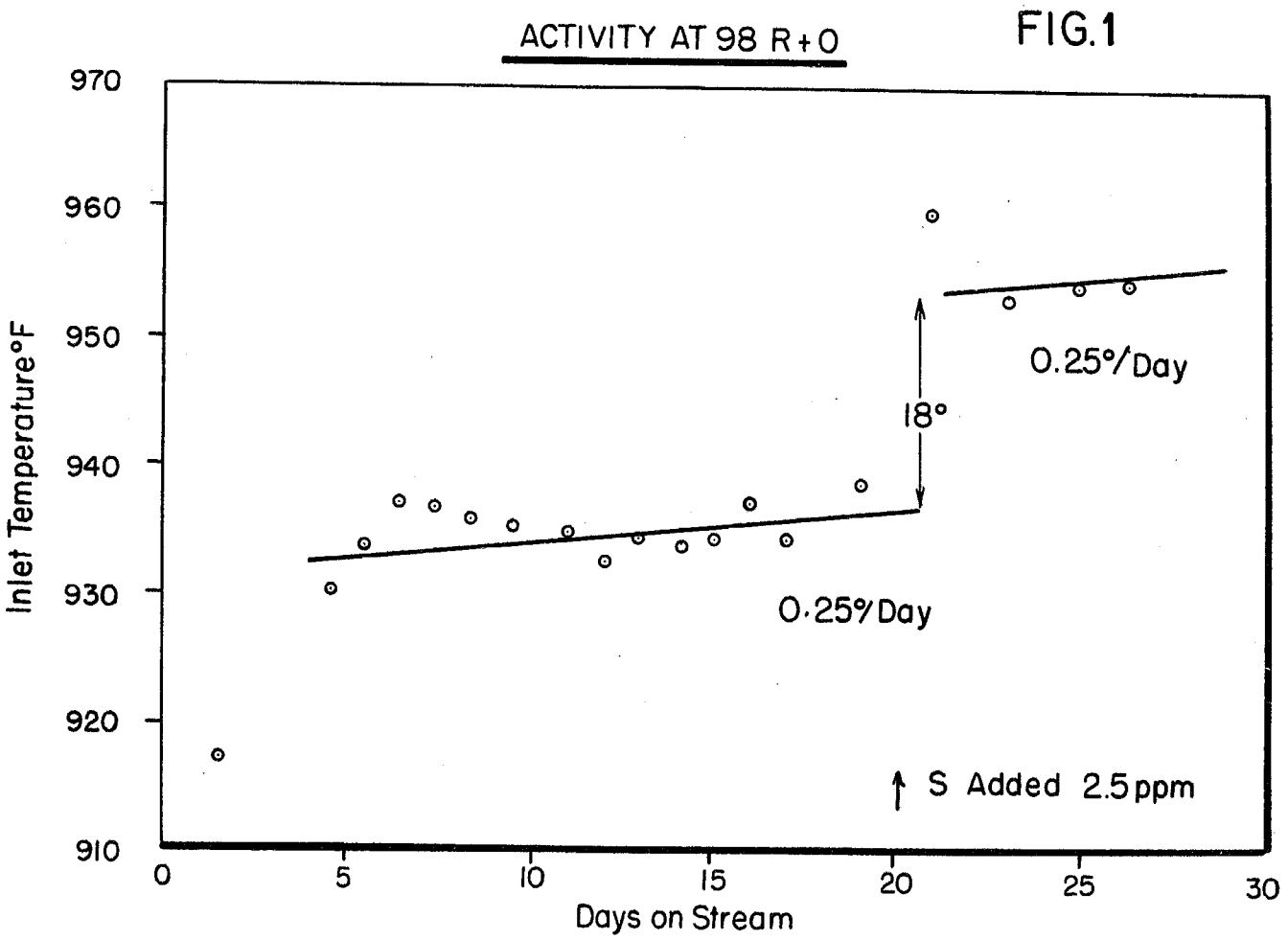
FIGS. 1, 2 and 3 depict the results of sulfur addition on the activity and aging of catalysts made up of separately supported platinum and iridium particles.

Charge stocks undergoing reforming, in accordance with the process described herein, are contemplated as those conventionally employed. These include virgin naphtha, cracked naphtha, gasoline, including FCC gasoline or mixtures thereof boiling within the approximate range of 70° to 500° F. and, preferably within the range of about 120° to about 450° F. The charge should be essentially sulfur-free with multimetallic reforming catalysts, that is, the feed should preferably contain less than about 1 ppm sulfur and preferably less than 0.5 ppm. The presence of sulfur in the charge decreases the activity of the catalyst as well as its stability. One of the advantages of employing the platinum-iridium reforming catalyst described herein where platinum and iridium are deposited on separate particles of a refractory support is that a higher initial tolerance of sulfur can be accepted, i.e., less severe pretreatment is required, than with the use of prior platinum-iridium reforming catalysts in which both metals were deposited or otherwise associated with a single support.

In instances where the chargestock is not already low in sulfur acceptable levels can be reached by hydrogenating the chargestock in a pretreatment zone wherein the chargestock is contacted with a hydrogenation catalyst which is resistant to sulfur poisoning. A suitable catalyst for this hydrodesulfurization process, is, for example, an alumina-containing support and a minor proportion of molybdenum oxide and cobalt oxide. Such hydrodesulfurization is ordinarily accomplished at 700°-850° F. at 200 to 2000 psig and at a liquid hourly space velocity of 1 to 5. The sulfur contained in the chargestock is converted to hydrogen sulfide, which can be removed by suitable conventional methods prior to reforming.

During startup of a reforming operation excessive amounts of light gases, e.g., methane, and ethane are produced as a result of high hydrocracking activity of the catalyst. Presulfiding of the catalyst, generally by treating with $H_2S$, prior to contact with the chargestock, serves to reduce the hydrocracking activity of the catalyst. After the catalyst has been presulfided, chargestick is introduced into the reforming unit and such unit is placed on stream in accordance with conventional procedure. Thereafter, during the course of the reforming operation, and particularly with platinum-iridium catalysts, certain adverse affects are observed, namely a reduction in $C_5+$ yield, a decrease in hydrogen production and an undesired increase in light gas production, e.g. methane and ethane.

The present process is particularly directed to those operations wherein small amounts of sulfur are injected into the reaction zone during the reforming process. Intermittent and preferably continuous injection of small amounts oil sulfur serve to counteract the aforenoted adverse affects encountered, particularly with platinum-iridium reforming catalysts. Thus, it has been found that the introduction of sulfur into the reforming unit containing the catalyst of separately supported platinum and iridium particles utilized in the present process is beneficial in maintaining a high yield of $C_5+$ production, an increase in hydrogen yield and decrease in methane production. The sulfur may be introduced in any desired fashion, namely as $H_2S$, dimethyldisulfide or other sulfur-containing compound. A particularly convenient manner of adding the sulfur is in the form of an untreated sulfur-containing naphtha. At least part of the sulfur injected will sulfide at least part of the metals, platinum and iridium present in the catalyst. The remaining sulfur builds up to a constant concentration in the reforming unit and subsequently passes therefrom, along with hydrogen and reformate product.

Utilizing the catalyst described hereinabove made up of separately supported particles of platinum and iridium, reforming operation under the conditions specified can be conducted with less severe pretreatment of the charge stock. In addition, sulfur upsets during the reforming cycle will have a smaller effect on its performance. Further with the process described herein, selectivities of the catalyst can be shifted without incurring any dramatic loss in stability.

Following the teachings of this invention, it has been found that reforming under the above conditions in the presence of added sulfur with a catalyst comprising a refractory support and specified minor amounts of platinum, iridium and halogen where the platinum and iridium components are deposited on separate particles of the support affords a much more effective and sulfur-resistant catalyst than previously employed platinum-iridium catalysts wherein the metals were deposited by coimpregnation or otherwise intimately associated with a single support.

The relative weight ratio of the particles containing platinum and those containing iridium in the catalyst used in the present process should be between about 10:1 and about 1:10. The size of the separate particles may range from powder of about 0.01 micron to particles of about 10,000 microns. Preferably, the size of the particles will be within the approximate range of 1 to 3,000 microns, with the size of the platinum-containing and iridium-containing particles either being of differing size within the above range or of substantially the same size.

The charge stock is contacted in the vapor phase with the catalyst at a liquid hourly space velocity between about 0.1 and about 10 and preferably between 0.5 and about 4. Reaction temperature is within the approximate range of 700° F. to 1000° F. and preferably between about 800° F. and about 1000° F. Hydrogen may be recycled to the reaction zone at a rate corresponding to a mole ratio of hydrogen to hydrocarbon charge of between about 0.5 and about 20 and preferably between about 2 and about 12 psig. Since the reforming process produces large quantities of hydrogen, at least a portion thereof may be conveniently employed for the introduction of hydrogen with the feed.

The refractory support of the catalyst employed is a porous adsorptive material having a surface area exceeding 20 square meters per gram and preferably greater than about 100 square meters per gram. Refractory inorganic oxides are preferred supports, particularly alumina or mixtures thereof with silica. Alumina is particularly preferred and may be used in a large variety of forms including alumina, precipitate or gel, alumina monohydrate, sintered alumina and the like. Various forms of alumina either singly or in combination, such as eta, chi, gamma, theta, delta or alpha alumina may be suitably employed as the alumina support. Preferably, the alumina is gamma alumina and/or eta alumina. The above nomenclature used in the presented specification and claims with reference to alumina phase designation is that generally employed in the United States and described in "The Alumina Industry: Aluminum and its Production" by Edwards, Frary and Jeffries, published by McGraw-Hill (1930).

The refractory support, desirably alumina, having a particle size of at least about 0.01 micron and generally not exceeding about 10,000 microns is contacted with a source of halogen. Both the particles of platinum-containing refractory support and the separate particles of iridium-containing refractory support will contain halogen.

Halogen may be added to the support, preferably alumina, in a form which will readily react therewith in order to obtain the desired results. One feasible method of adding the halogen is in the form of an acid, such as hydrogen fluoride, hydrogen bromide, hydrogen chloride and/or hydrogen iodide. Other suitable sources of halogen include volatile salts, such as ammonium fluoride, ammonium chloride and the like. When such salts are used, the ammonium ions will be removed during subsequent heating of the catalyst. Halogen may also be added as fluorine, chlorine, bromine or iodine or by treatment in gaseous hydrogen halide. The halogen, preferably a chlorine or fluorine moiety, may be incorporated into the catalyst at any suitable stage in the catalyst manufacture. Thus, halogen may be added before, after or during incorporation of the platinum and iridium on the separate particles of refractory support. Halogen is conveniently incorporated into the catalyst when impregnating the support with halogen-containing metal compounds, such as chloroplatinic acid and chloroiridic acid. Additional amounts of halogen may be incorporated in the catalyst by contacting it with materials, such as hydrogen fluoride and hydrogen chloride, either prior to or subsequent to the metal impregnation step. Halogen may also be incorporated by contacting the catalyst with a gaseous stream containing the halogen, such as chlorine or hydrogen chloride. One feasible way to halogenate the alumina is by the addition of an alkyl halide, such as tertiary butyl chloride during the reforming operation. The amount of halogen introduced into the support is that the halogen content of the overall catalyst is between about 0.1 and about 5 weight percent. Such halogen content may be deposited on either the platinum-containing or iridium-containing particles, and desirably is present on both particles in an approximate range which may be extended from 1:10 to 10:1 of the total halogen content. Generally, as a preferred and practical matter, the halogen content of each of the particles making up the catalyst of the invention will be approximately the same.

The platinum metal may be deposited on the support, desirably alumina, in any suitable manner. Generally, it is feasible to mix particles of support with a platinum compound such as chloroplatinic acid, platinum tetrachloride, bromoplatinic acid, the ammonium salt of chloroplatinic or bromoplatinic acid.

The iridium metal may be deposited on the support, desirably alumina, by contacting with an appropriate iridium compound such as the ammonium chloride double salt, tribromide, tetrachloride or chloroiridic acid. Iridium amine complexes may also suitably be employed.

The impregnated particles may then be dried in air at an elevated temperature generally not exceeding 250° C. prior to introduction of the catalyst into the reforming unit. Optionally, the catalyst may be exposed to a hydrogen atmosphere to reduce a substantial portion of the platinum and/or iridium component to the elemental state.

It is to be noted that the catalyst of the present invention may contain in addition to platinum and iridium, one of several additional catalytic components such as silver, osmium, copper, gold, palladium, rhodium, gallium, rhenium, germanium or tin or compounds thereof on one support and one or more such additional catalytic components on a second support, which also contains the iridium. The amounts of the added catalytic components may be in the approximate range of 0.01 to 2 weight percent, preferably between about 0.1 and about 1.0 weight percent. The platinum content, iridium content and halogen content of catalysts is in the same range as set forth hereinabove, with the preferred support being alumina.

A very distinct advantage of the reforming catalyst described herein containing separate platinum/alumina and separate iridium/alumina particles is its ability to maintain catalytic activity over an extended period of time. In a typical commercial reforming process, reaction temperature is increased during the course of the run to maintain a constant product octane level. Increasing the reaction temperature becomes necessary since the catalyst is continuously deactivated. Generally, the reaction temperature cannot exceed about 1000° F. before rapid deactivation of the catalyst is encountered. Accordingly, as the reaction temperature approaches about 1000° F., it is usually necessary to regenerate the catalyst. Regeneration is accomplished in accordance with conventional procedure by burning the coke deposit from the catalyst.

It is contemplated that the catalyst described hereinabove may be employed in any of the conventional types of processing equipment. Thus, the catalyst may be used in the form of pills, pellets, extrudates, spheres, granules, broken fragments or various other shapes dispersed as a fixed bed within a reaction zone. The charge stock may be passed through the catalyst bed as a liquid, vapor or mixed phase in either upward or downward flow. The catalyst may also be used in a form suitable for moving beds. In such instances, the charge stock and catalyst are contacted in a reforming zone wherein the charge stock may be passed in concurrent or countercurrent flow to the catalyst. Alternatively, a suspensiod-type process may be employed in which the catalyst is slurried in the charge stock and the resulting mixture conveyed to the reaction zone. The reforming process is generally carried out in a series of several reactors. Usually, three to five reactors are used. The catalyst of the invention may be employed in just one of the reactors, e.g., the first reactor or in several reactors or in all reactors. After reaction, the product from any of the above processes is separated from the catalyst by known techniques and conducted to distillation columns where the various desired components are obtained by fractionation.

In accordance with one embodiment of this invention, it is possible to isolate the platinum-containing portion of the catalyst from the iridium-containing portion since the same are located on separate particles. Thus, should a catalyst of the present invention become deactivated due to the loss of activity of either the platinum-containing or the iridium-containing portion of the catalyst, it is only necessary to activate that portion of the catalyst which is adversely affected rather than the whole catalyst. It is thus possible to provide separate and optimum means for ready regeneration of each of the two components. For example, the catalyst of the present invention after becoming spent, may be separated into its components of platinum-containing components and iridium-containing components by providing the respective particles with a different physical characteristic which permit their ready separation, such as a difference in particle size. The particles of differing size may be separated by flotation, air blowing, sifting or by any of the various other known means for separating physically and/or chemically different materials. The separated platinum-containing and iridium-containing particles may then be separately regenerated under conditions best suited for each.

The ability to select the amount of platinum-containing component and the amount of iridium-containing component making up the ultimate catalyst mixture has the advantage that the amount of platinum, as well as the amount of iridium contained in the catalyst, can be controlled not only by the respective concentrations of the platinum and iridium impregnating solutions used but also by the respective amounts of the platinum-containing and iridium-containing components of the catalyst. If the two-component catalyst of this invention is used in the form of a mixture of particles, the two components of the mixture will be physically independent. Accordingly, a process using catalysts in this form affords substantial flexibility in catalyst composition within the limits noted hereinabove. Thus, in changing type of charge stocks such as between paraffinic and naphthenic stocks, the catalyst composition can be adjusted with respect to activity and/or selectivity for optimum performance in accordance with this invention by adding or withdrawing one or the other of the catalyst components.

It is also within the purview of this invention to select the refractory support most suitable for use with the metal deposited thereon. The separate particles making up the present catalyst afford flexibility in choice of refractory support, such as the type of alumina employed. Thus, in one embodiment it is contemplated that iridium is desirably deposited on the more acidic eta form of alumina with platinum being deposited on the gamma form of alumina. Such catalyst would have the advantage of reducing the amount of light hydrocarbons, such as methane and ethane to yield a stream of hydrogen of enhanced purity, suitable for recycle or other use.

The following examples will serve to illustrate the process of the invention without limiting the same:

EXAMPLE 1

Two portions of the gamma $Al_2O_3$ extrudate were impregnated to 0.6% metal with $H_2PtCl_6$ and $H_2IrCl_6$ solutions separately, and each component was dried. The Pt component was calcined in air at 950° F. (3 hours) and the Ir component heated at 750° F. in nitrogen (3 hours). Thereafter, the Pt component and Ir components were mixed in a Li 1:1 weight ratio. Examination of each component showed the metal distributed as a shell about the alumina extrudate.

EXAMPLE 2

Platinum-iridium catalyst was deposited on gamma alumina beads. 100 grams containing 0.6% Pt was impregnated by contacting with hexachloroplatinic acid solution. 100 grams of the beads were thus treated with 145 ml. solution containing 0.6 grams platinum as hexachloroplatinic acid. Thereafter, the platinum was taken up by the catalyst carrier. The catalyst was than dried overnight at 110° C. The second part was made by impregnating 62.2 grams alumina beads with 90 ml. of solution containing 1 gram $H_2IrCl_6 \cdot 6\ H_2O$ containing 37.3% Ir. The procedure was the same as with platinum above.

EXAMPLE 3

Gamma alumina, 1/16" beads coimpregnated, 0.3% Pt+0.3% Ir/1 gram hexachloroplatinic acid, $H_2PtCl_6 \cdot 6H_2O$+1 gram hexachlororidic acid, $H_2IrCl_6 \cdot 6\ H_2O$ were dissolved in 180 ml. water, and 125 grams gamma alumina, 1/16" beads added to the solution. The beads were soaked overnight, then dried overnight at 110° C. The catalyst was then calcined for 4 hours at 250° C.

The above catalysts of Examples 1–3, along with a catalyst of the same platinum and iridium content, but having highly dispersed polymetallic cluster of platinum and iridium on a single support of alumina, designated commercially as "KX-130" and prepared according to U.S. Pat. No. 3,953,368 were tested for reforming utilizing a charge constituting a $C_6$-330 Arab Light Naphtha to which 2.5 ppm by weight of sulfur were added after the 28th day in the form of untreated naphtha.

Reforming of the above charge was accomplished in an adiabatic three reactor system at a pressure of 200 psig, a recycle mole ratio of hydrogen to charge of 5 and a weight hourly space velocity of 2.5.

The results obtained are shown graphically in the attached figures where inlet temperature necessary to obtain a product having a $C_5$+ Reseach Clear Octane Number of 98 is plotted against time on stream. Comparative results obtained using the catalyst as separately supported platinum and iridium particles (Examples 1 and 2) with results obtained under identical reaction conditions employing a catalyst of the same platinum and iridium content but wherein the metals are coimpregnated on a single support of alumina (Example 3) and the aforenoted commercial "KX-130" catalyst are set forth.

Figure 2:
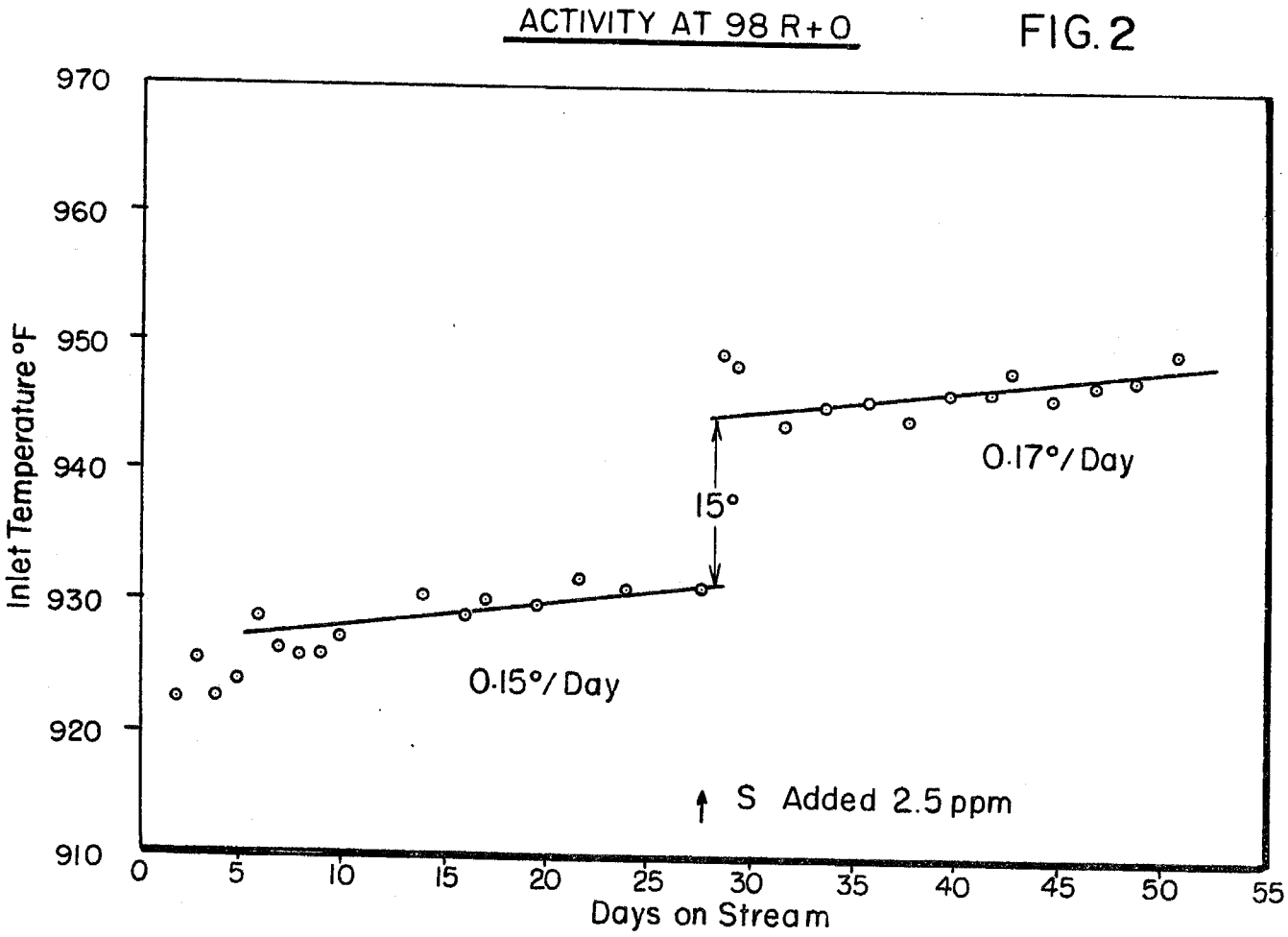
Figure 3:
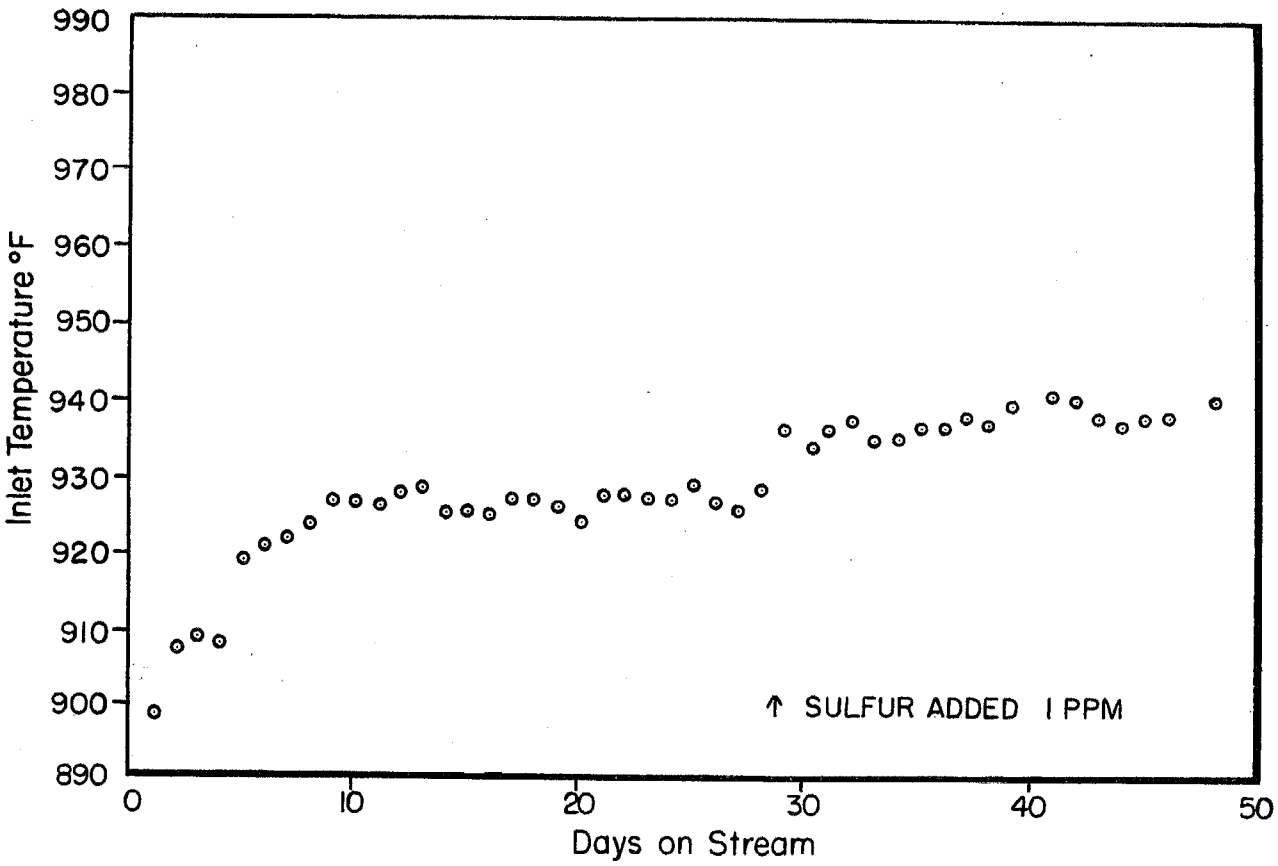

Referring more particularly to FIGS. 1, 2 and 3, the results of sulfur addition on the activity and aging of catalysts composed of separately impregnated platinum and iridium particles are shown. When these types of catalysts are exposed to sulfur, there is a loss of activity from 10° F. to 18° F. as shown in FIGS. 1 through 3. Unexpectedly, from the three above Figures, it will be seen that the aging rate after the sulfur addition was approximately equal to the aging rate before sulfur addition. For example, in FIG. 2, the aging rate before sulfur addition was 0.15° F./day, while after sulfur was added the aging rate was 0.17° F./day.

Figure 4:
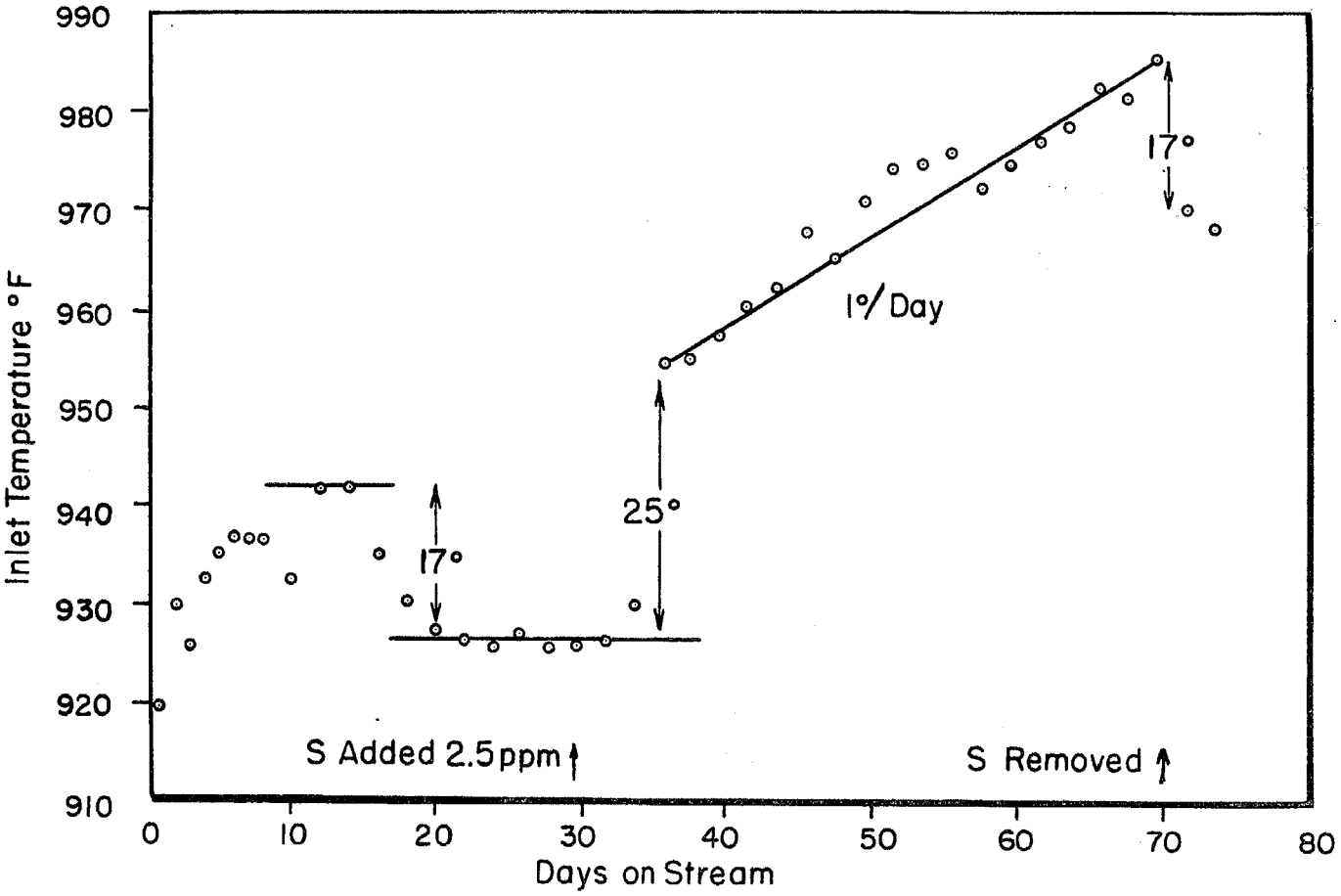
FIGS. 4 and 5 depict the results of sulfur addition on the activity and aging of catalysts wherein platinum and iridium are deposited by coimpregnation on a single support.
Figure 5:
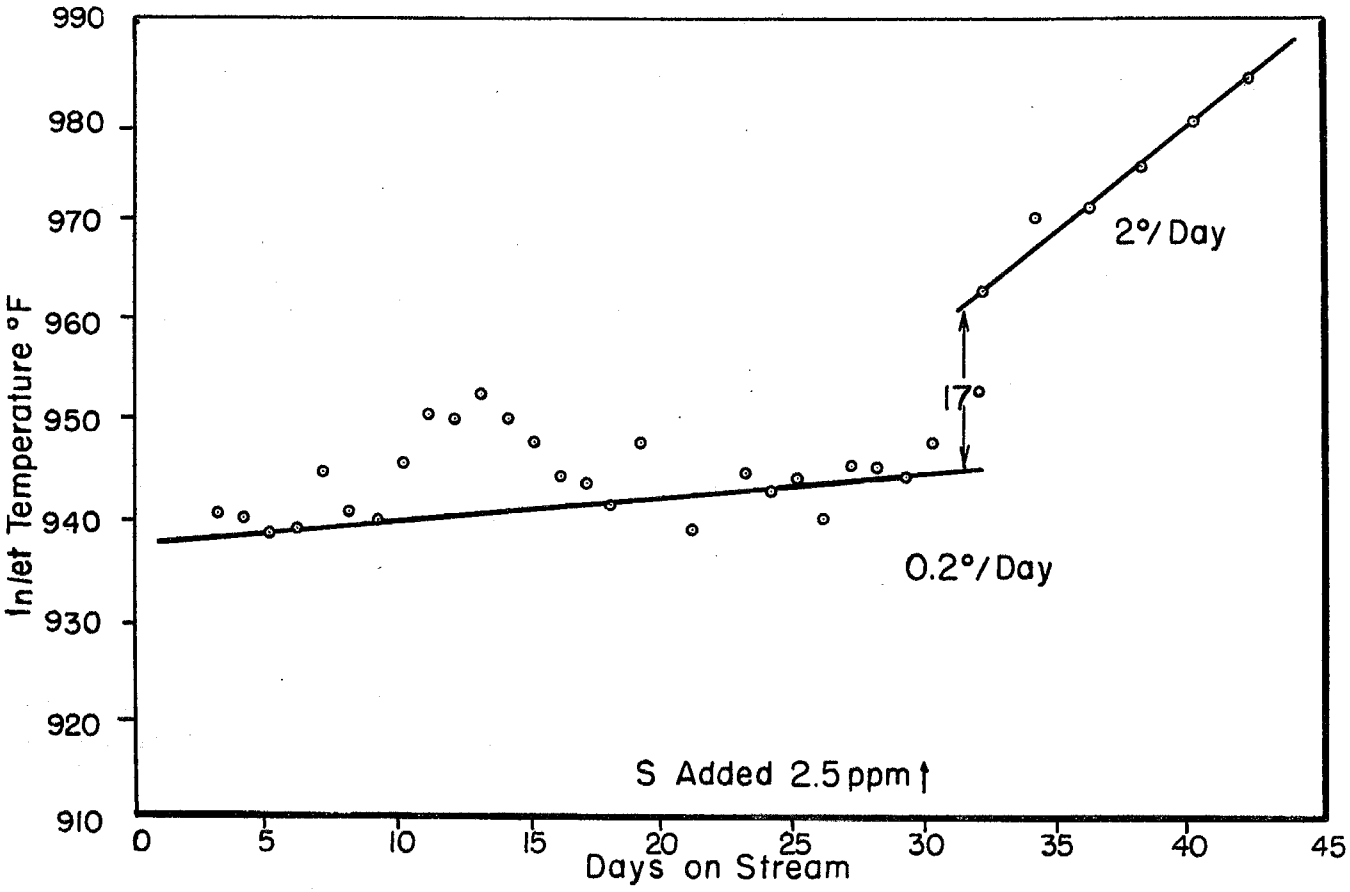

The coimpregnated platinum and iridium catalysts of Example 3 and "KX-130", on the other hand, differed substantially in their aging rates before and after the addition of sulfur. This behavior is shown in FIGS. 4 and 5. FIG. 4 shows the activity of the coimpregnated catalyst of Example 3. As will be seen, the aging rate of this catalyst increased from a low level of substantially 0° F./day before sulfur addition to 1° F./day after exposure to sulfur. Thus, the aging rate after exposure to sulfur, of the coimpregnated Pt-Ir catalyst of Example 3 was approximately 6 times greater than that of the separated supported Pt-Ir catalyst of Example 2. FIG. 5 shows the activity of a coimpregnated catalyst, KX-130, before and after sulfur addition. The aging rate before sulfur addition was 0.2° F./day while after sulfur was added, the aging rate increased to to 2.0° F./day. Thus, the aging rate, after sulfur addition, of the commercially available KX-130 was more than 10 times greater than that of the separately supported Pt-Ir catalyst of Example 2.

The very substantial differences in sulfur sensitivity between the two types of catalysts, graphically presented in FIGS. 1–5, are summarized below in Table I:

TABLE I

| | | SEPARATELY IMPREGNATED CATALYST | | | COIMPREGNATED CATALYST | |
|---|---|---|---|---|---|---|
| | | Catalyst of Ex. 1 | Catalyst of Ex. 2 first cycle | Catalyst of Ex. 2 third cycle | KX-130 | Catalyst of Ex. 3 |
| Activity | Before Sulfur | 935° F. | 930° F. | 928° F. | 945° F. | 928° |
| | After Sulfur | 955° F. | 945° F. | 936° F. | 960° F. | 955° |
| Aging Rate | Before Sulfur | 0.25° F./day | 0.15° F./day | 0.1° F./day | 0.2° F./day | 0.1° F./day |
| | After Sulfur | 0.25° F./day | 0.17° F./day | 0.1° F./day | 2.0° F./day | 1.0° F./day |

Figure 6:
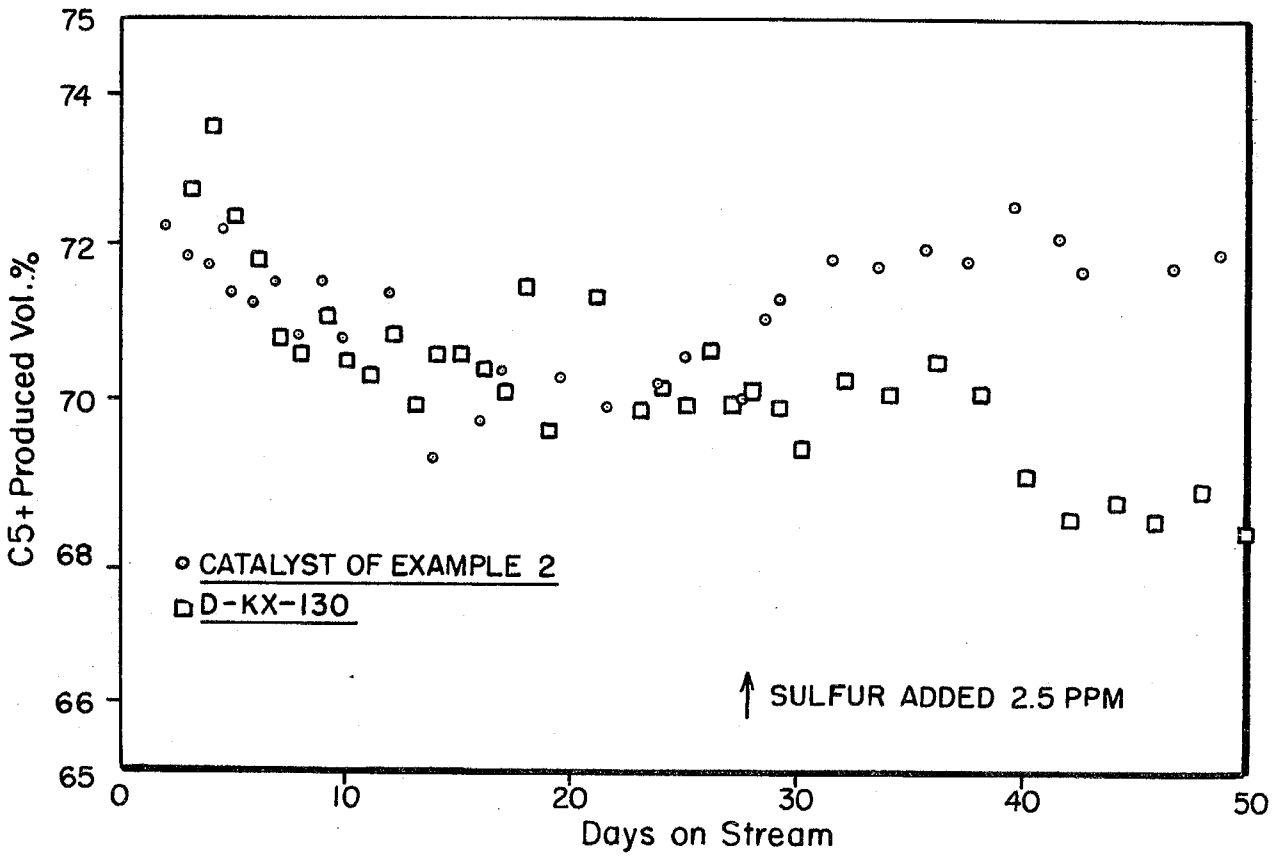
FIG. 6 depicts comparative results in $C_5+$ yield obtained utilizing the separately supported and coimpregnated platinum-iridium catalysts.

In FIG. 6, the $C_5$+ yield obtained with the coimpregnated "KX-130" is contrasted with the catalyst of Example 2 wherein platinum and iridium are deposted on separate alumina particles. From the Figure, the effect of sulfur addition on $C_5$+ yield is evident. A comparative advantage with the separately supported platinum and iridium catalyst of 2% $C_5$+ yield was observed immediately after addition of sulfur, which after ten days increased to a 4% advantage in $C_5$+ yield, i.e., from 72% to 68%.

Figure 7:
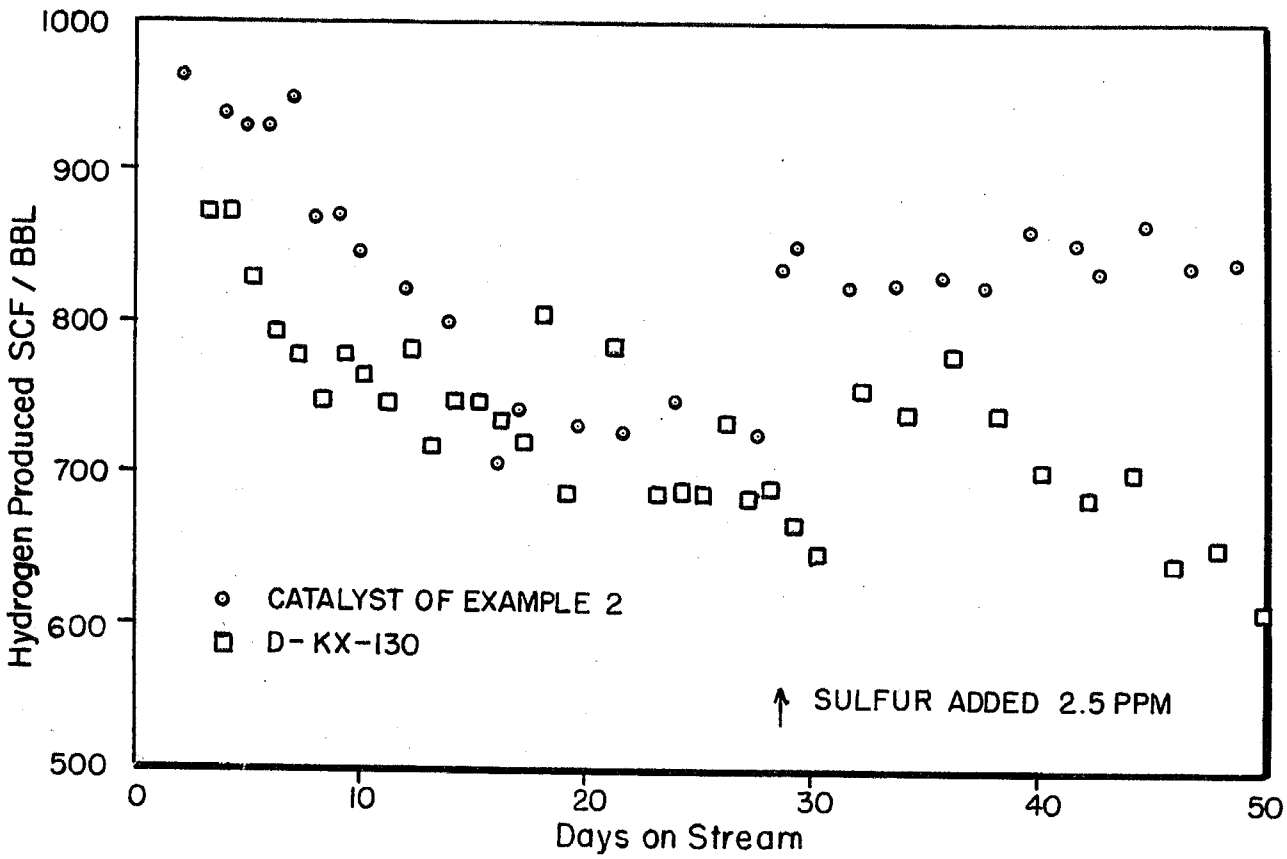
FIG. 7 depicts comparative hydrogen product obtained utilizing the separately supported and coimpregnated platinum-iridium catalyst.

The concurrent effect sulfur has on hydrogen production is also important and significant as another area of difference between the two types of catalyst. Such is evident from the data depicted graphically in FIG. 7 where a comparison is shown before and after sulfur addition for the "KX-130" catalyst and the catalyst of Example 2 (first cycle). The hydrogen increase with sulfur for "KX-130" was initially about 100 SCF/BBL resulting in 750 SCF/BBL total. This amount quickly decreased because of the increased aging rate. In contrast, the increased production of hydrogen for the catalyst utilizing the process of the invention was about 200 SCF/BBL resulting in 850 SCF/BBL total. This level persisted because of the low rate of aging.

From the above, it is evident that the reforming catalyst consisting of iridium and platinum deposited on separate particles, exhibited decreased susceptibility to the detrimental effects of sulfur. An exceedingly important benefit and advantage derived from the use of the catalyst employed in the present process is decreased catalyst aging during the course of the reforming operation in the presence of aging. In addition, with use of the present catalyst, further benefits are achieved, namely a sustained increase in $C_5$+ yield and hydrogen production. It follows for the foregoing that sulfur upsets which may occur from time to time in commercial reforming operations are capable of being handled without the drastic shortening of this cycle length heretofore experienced with the previously employed coimpregnated platinum-iridium reforming catalyst.

It is to be understood that the above description is merely illustrative of preferred embodiments of the invention, of which many variations may be made within the scope of the following claims by those skilled in the art without departing from the spirit thereof.

What is claimed is:

1. In a process for reforming a hydrocarbon charge under reforming conditions in the presence of a reforming catalyst contained in a reforming zone wherein said charge conducted to said reforming zone is initially substantially sulfur-free and wherein excessive hydrocracking of said charge, with concomittant loss in the activity of said catalyst is reduced by the introduction of sulfur into said charge, the improvement which comprises utilizing as said catalyst a composition consisting essentially of a minor proportion of platinum on a support and a minor proportion of iridium on a separate support.

2. The process of claim 1 wherein said hydrocarbon charge is a petroleum naphtha.

3. The process of claim 1 wherein said catalyst comprises a refractory support, about 0.1 to about 5 percent by weight of platinum, about 0.1 to about 5 weight percent by weight of iridium, about 0.1 to about 5 weight percent of halogen, with the relative weight ratio of the particles containing platinum and those containing iridium being between about 10:1 and 1:10.

4. The process of claim 3 wherein said refractory support is an inorganic oxide.

5. The process of claim 3 wherein said refractory support is alumina.

6. The process of claim 3 wherein said halogen is chlorine.

7. The process of claim 1 wherein the amount of added sulfur introduced into said reaction zone constitutes between about 0.3 and about 50 ppm of said charge.

8. The process of claim 1 wherein the amount of added sulfur introduced into said reaction zone constitutes between about 0.5 and about 5 ppm of said charge.

9. In a process for reforming a hydrocarbon charge under reforming conditions in the presence of a reforming catalyst contained in a reforming zone wherein said charge conducted to said reforming zone is initially substantially sulfur-free and wherein excessive hydrocracking of said charge, with concommittant loss in the activity of said catalyst is reduced by the introduction of sulfur into said charge, the improvement which comprises utilizing as said catalyst a composition consisting essentially of a mixture of two components, one of said components comprising a minor proportion of platinum on a support and another of said components consisting essentially of a minor proportion of iridium on a separate support.

10. The process of claim 9 wherein said hydrocarbon charge is a petroleum naphtha.

11. The process of claim 9 wherein the platinum-containing component also contains an additional component selected from the group consisting of silver, osmium, copper, gold, palladium, rhodium, gallium, rhenium, germanium, tin and compounds thereof.

12. The process of claim 9 wherein the platinum-containing component also contains rhenium in an amount between about 0.01 and about 2 weight percent.

13. The process of claim 9 wherein said catalyst comprises a refractory support, about 0.1 to about 5 percent by weight of platinum, about 0.1 to about 5 weight percent by weight of iridium, about 0.1 to about 5 weight percent of halogen, with the relative weight ratio of the particles containing platinum and those containing iridium being between about 10:1 and 1:10.

14. The process of claim 9 wherein said support is alumina.

15. The process of claim 13 wherein said halogen is chlorine.

16. The process of claim 9 wherein the amount of added sulfur introduced into said reaction zone constitutes between about 0.5 and about 5 ppm of said charge.

* * * * *